US005384977A

United States Patent [19]

Chee

[11] Patent Number: 5,384,977

[45] Date of Patent: Jan. 31, 1995

[54] SPORTS FOOTWEAR

[75] Inventor: Wong K. Chee, Kowloon, Hong Kong

[73] Assignee: Global Sports Technologies Inc., Tortola, Virgin Islands (Br.)

[21] Appl. No.: 81,151

[22] Filed: Jun. 25, 1993

[51] Int. Cl.[6] ..... A43B 13/18

[52] U.S. Cl. ..... 36/28; 36/35 B

[58] Field of Search ..... 36/28, 29, 35 B, 35 R, 36/37, 114, 88, 89, 93, 71, 153

[56] References Cited

U.S. PATENT DOCUMENTS

| | | | |
|---|---|---|---|
| 532,429 | 1/1895 | Rogers | 36/28 |
| 1,598,809 | 9/1926 | Dressel . | |
| 1,605,588 | 11/1926 | Huiskamp . | |
| 1,981,300 | 11/1934 | Berg . | |
| 2,721,400 | 10/1955 | Isreal | 36/28 X |
| 3,253,355 | 5/1966 | Menken . | |
| 4,012,854 | 3/1977 | Berend et al. . | |
| 4,187,620 | 2/1980 | Selner | 36/28 |
| 4,219,945 | 9/1980 | Rudy . | |
| 4,236,326 | 12/1980 | Inohara . | |
| 4,262,433 | 4/1981 | Hagg et al. | 36/35 B X |
| 4,297,797 | 11/1981 | Meyers . | |
| 4,358,902 | 11/1982 | Cole et al. . | |
| 4,364,186 | 12/1982 | Fukuoka . | |
| 4,391,048 | 7/1983 | Lutz . | |
| 4,397,104 | 8/1983 | Doak . | |
| 4,417,407 | 11/1983 | Fukuoka . | |
| 4,446,634 | 5/1984 | Johnson et al. . | |
| 4,472,890 | 9/1984 | Gilbert . | |
| 4,535,553 | 8/1985 | Derderian et al. . | |
| 4,546,555 | 10/1985 | Spademan . | |
| 4,610,099 | 9/1986 | Signori . | |
| 4,631,843 | 12/1986 | Annovi . | |
| 4,674,206 | 6/1987 | Lyden . | |
| 4,768,295 | 9/1988 | Ito . | |
| 4,783,910 | 11/1988 | Boys, II et al. . | |
| 4,794,707 | 1/1989 | Franklin et al. . | |
| 4,815,221 | 3/1989 | Diaz . | |
| 4,817,304 | 4/1989 | Parker et al. . | |
| 4,874,640 | 10/1989 | Donzis . | |
| 4,887,367 | 12/1989 | Mackness et al. . | |
| 4,908,962 | 3/1990 | Yung-Mao . | |
| 4,912,861 | 4/1990 | Huang . | |
| 4,918,838 | 4/1990 | Chang . | |
| 4,924,605 | 5/1990 | Spademan . | |
| 4,934,072 | 6/1990 | Fredericksen et al. . | |
| 4,936,029 | 6/1990 | Rudy . | |
| 4,956,927 | 9/1990 | Misevich et al. . | |
| 4,970,807 | 11/1990 | Anderie et al. . | |
| 4,993,173 | 2/1991 | Gardiner . | |
| 4,995,173 | 2/1991 | Spier . | |
| 4,999,932 | 3/1991 | Grim . | |
| 5,010,661 | 4/1991 | Chu . | |
| 5,010,662 | 4/1991 | Dabuzhsky et al. . | |
| 5,025,575 | 6/1991 | Lakic . | |
| 5,042,176 | 8/1991 | Rudy . | |
| 5,067,256 | 11/1991 | Darby . | |
| 5,068,981 | 12/1991 | Jung . | |
| 5,074,765 | 12/1991 | Pekar . | |
| 5,086,574 | 2/1992 | Bacchiocci . | |
| 5,092,060 | 3/1992 | Frachey et al. . | |
| 5,113,599 | 5/1992 | Cohen et al. . | |
| 5,158,767 | 10/1992 | Cohen et al. . | |
| 5,174,049 | 12/1992 | Flemming | 36/29 X |
| 5,224,278 | 7/1993 | Jeon | 36/35 B X |
| 5,233,767 | 8/1993 | Kramer | 36/28 |
| 5,253,435 | 10/1993 | Auger et al. | 36/114 X |
| 5,512,083 | 10/1992 | Gagne . | |

FOREIGN PATENT DOCUMENTS

| | | | |
|---|---|---|---|
| 0215995 | 4/1987 | European Pat. Off. . | |
| 2252820 | 6/1975 | France . | |
| 2535950 | 5/1984 | France . | |
| 806647 | 7/1949 | Germany . | |
| 2901084 | 7/1980 | Germany . | |
| 3427644 | 1/1986 | Germany | 36/119 |
| 601627 | 8/1944 | United Kingdom . | |
| 2183446 | 6/1987 | United Kingdom . | |

*Primary Examiner*—Paul T. Sewell

*Assistant Examiner*—Ted Kavanaugh

*Attorney, Agent, or Firm*—Oblon, Spivak, McClelland, Maier, & Neustadt

[57] ABSTRACT

Improved sports footwear which includes an insert positioned at least in the heel region of a shoe, the insert including an elastically deformable cellular structure arranged within an elastically deformable air-impermeable casing provided with inner projections on opposing faces. The casing is pneumatically connected to controllable mechanism, rigid with the footwear, for varying the air pressure within the casing so as to modify the elastic characteristics of the insert. Each projection on one face thereof is connected to a face portion of an opposing projection.

8 Claims, 3 Drawing Sheets

SPORTS FOOTWEAR

BACKGROUND OF THE INVENTION

1. Field of the Invention

This invention relates to improved footwear for athletes, of the type containing an insert at least in the heel region, the insert comprising an airtight flexible plastics casing enclosing a series of interconnected elastically deformable bodies.

2. Discussion of Background

It is well known that athletic footwear must provide a stable support region which at the same time is comfortable for the foot and hence for the athlete's body, which is subjected to most various types of stress. To solve the problem of comfort with stable support, while also achieving a certain counterthrust effect, i.e. a partial recovery of the thrust as the footwear separates from the ground plus absorption of the impact against the ground, solutions of the type described in the preceding paragraph have been proposed.

The known-art inserts positioned in the footwear heel act primarily as a complex spring, so that after the impact of the footwear against the ground and the simultaneous damping effect, there is partial restitution of the energy absorbed by the insert on impact. Although the known inserts offer comfort, stability and adequate damping and energy recovery through a certain range of loading and impact velocity, they can prove partially unsatisfactory outside these ranges. For example, footwear provided with the insert in question can satisfy the requirements of slow movement but not of fast movement, whereas an insert designed for fast movement could prove too rigid for slow movement. In addition to this, for equal footwear size the weight of the wearer can vary within extremely wide limits, so that the same insert can prove either excessively rigid or excessively yielding.

SUMMARY OF THE INVENTION

The main object of the present invention is therefore to improve footwear provided with an insert of the type comprising an airtight casing of flexible material enclosing a plurality of interconnected elastic bodies, such that its rigidity can be matched both to the weight of the user and to the pace of movement at any given time.

A further object of the present invention is to provide footwear with an airtight insert of reduced weight.

A further object of the present invention is to provide footwear with several inserts positioned in regions of the footwear which are convenient for comfort and stability.

The aforesaid objects are attached according to the invention by providing the footwear with a pumping means pneumatically connected to the insert contained in the footwear heel region to increase the rigidity of the insert, and with bleeding means, also pneumatically connected to the insert, to decrease this rigidity.

BRIEF DESCRIPTION OF THE DRAWINGS

The invention will be more apparent from the detailed description of a preferred embodiment thereof given hereinafter by way of non-limiting example with reference to the accompanying drawing, in which.

DESCRIPTION OF THE PREFERRED EMBODIMENTS

Figure 1:
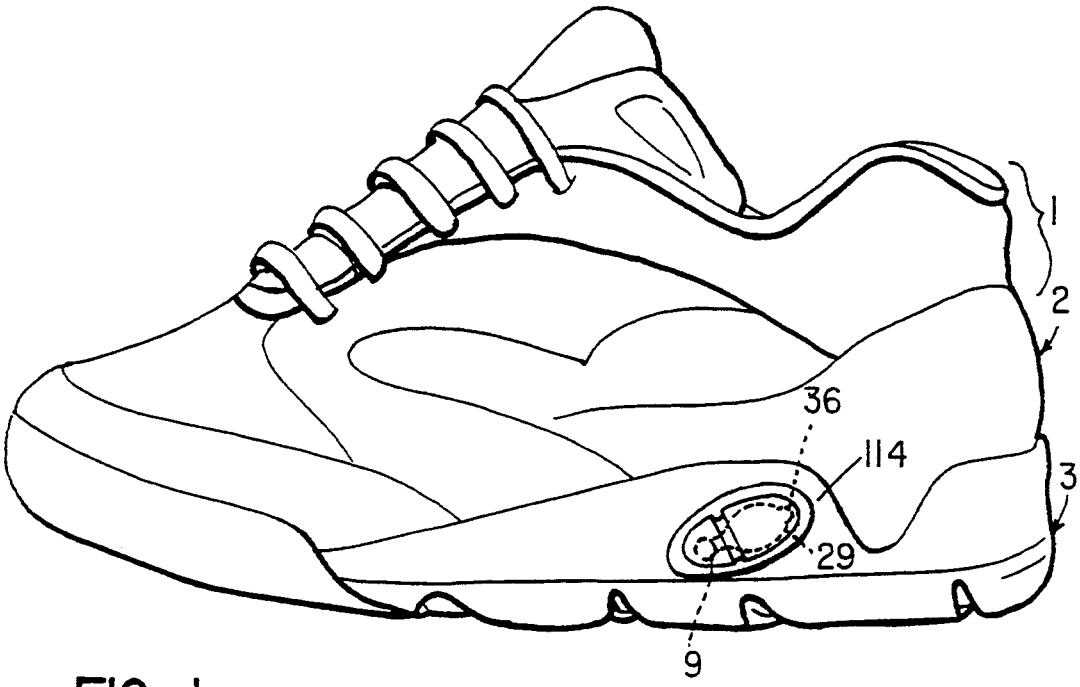
FIG. 1 is a side view of the improved footwear according to the invention.

In the figures the reference numeral 1 indicates overall the sports footwear, which comprises a vamp 2 and a sole 3. The sole can also consist of one or more layers of plastic materials, which can be different.

In the sole in a position corresponding with the user's heel there is provided a compartment containing an insert 4 formed from an elastically deformable cellular structure 5 of thermoplastics material enclosed in an airtight casing 6 of relatively thin flexible plastic material such as polyurethane or the like. Specifically, although non-limitatively, the cellular structure 5 defines a plurality of hexagonal cells 5A, some of which can be closed but only at one end, such as the cell 5A1. The cellular structure is prepared by mold any elastic synthetic material and is free within the casing 6, i.e. not connected thereto. The casing 6 is formed from two ports 6A and 6B welded together, and prepared for example by vacuum-forming. The part 6A has a tray configuration with a perimetral flange 7 and an appendix 8 on one side, this appendix being centrally of a semicircular shape (8A), and with two flat lateral flanges 8B. The tray part 6A also comprises an ordered series of substantially frusto-conical hollow projections 9 which extend within the interior of the casing obtained. The part 6B also comprises an appendix 10, which is substantially flat and is arranged to coincide with the appendix 8, and a series of frusto-conical hollow projections arranged to coincide with the projections 9 when the two parts 6A and 6B are joined together by welding along the superposed regions coinciding with the flanges 7 and 8B and with the inner ends 12 (see FIG. 4).

Before fixing the parts 6A, 6B of the casing 6 together, the light elastic cellular structure 5 is placed on one of these parts so that each of the hollow projections 9, 11 is located within a cell 5A (but obviously not within a cell 5A1, at which the parts 6A, 6B are without projections 9, 11).

The other part of the casing 6 is then placed thereon and the parts joined together by welding along said superposed regions to enclose the cellular structure 5 but without it being connected to the casing.

The height of the cellular structure 5 is substantially equal to the inner distance between the opposing walls 13, 14 of the casing 6, but such that all the internal regions of the casing are connected together pneumatically. By the joining together of the appendices 8 and 10 a duct or tube Z is formed communicating with the interior of the casing.

A cavity 15 and a channel 16 are provided in the sole 3. The cavity is provided in the heel and contains the insert 4 of corresponding shape, whereas the tube Z is positioned in the channel 16, which directs it to an outer lateral appendix 114 on the sole, where it terminates in an aperture in which it is fixed by a tubular appendix 115 of a plastic block 116 welded to the outside of the appendix 114 and comprising a chamber 17 in which the valve member 18 of a bleed valve 19 is slidingly mounted. The valve member 18 is of frusto-conical shape and is mounted at the end of a stem 20 of smaller cross-section. The stem passes loosely through a hole 21 and has a head 23. A compression spring 22 positioned between the block 16 and head 23 prevents the chamber 17 and hence the interior of the insert 4 from being connected to atmosphere, whereas if the head 23 is pressed to hence withdraw the valving member 18 from the hole 21, the interior of the insert becomes connected to atmosphere via the space between the stem 20 and the hole 21 which guides it.

The block 116 comprises a hollow lateral appendix 24 in which there is inserted a unidirectional valve 25 of elastic material comprising a seal flange 26, a tubular part 27 and two flat lips 28 which diverge to allow air to pass in the direction of the arrow R when pressure is applied to a bellows 29 of elastic material which by means of a lateral hollow appendix 30 is sealedly connected to the appendix 24. For this purpose the appendix 30 comprises an inner flange 31 which seats in a corresponding annular groove in the appendix 24 of the block 16. The bellows has a flat wall 29A by which it is fixed (welded) to the outer lateral appendix 114 of the sole.

The bellows 29 comprises a second tubular appendix 35, opposite the preceding, in which there is mounted an intake valve 36 comprising a tubular member 37 with a groove 38 into which an inner flange of the appendix 35 elastically clamps. The tubular member 37 comprises a narrow passage 39 which can be intercepted by a plastic disc 40 which moves between this passage and a series of radially arranged spaced-apart teeth 41 which prevent the disc 40 from becoming dislodged from tubular member 37.

Figure 4:
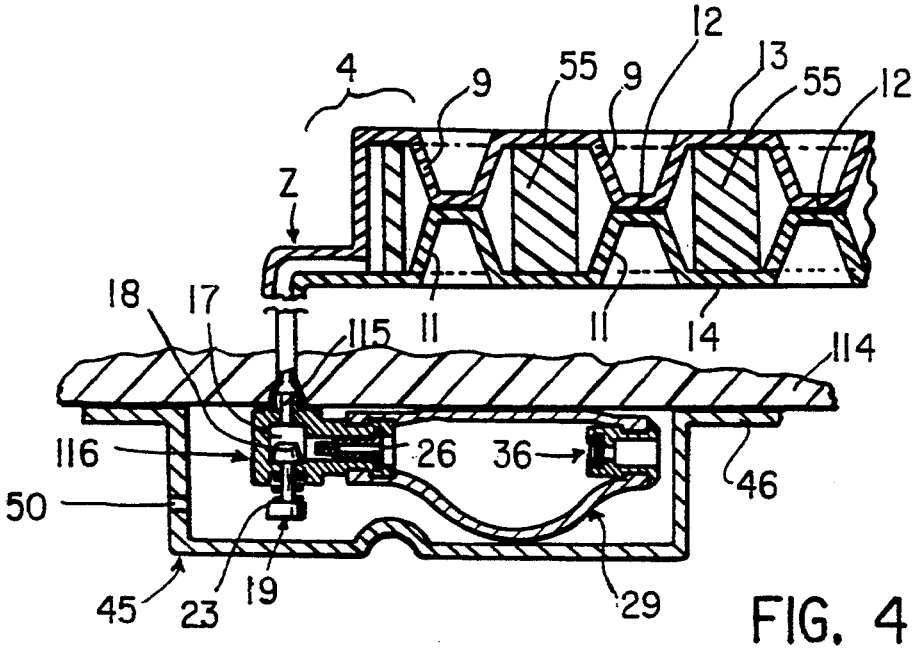
FIG. 4 shows on a different scale the sectional view taken along line IV—IV of FIG. 3, but complete with the cover and in association with the insert, shown only partially.
Figure 5:
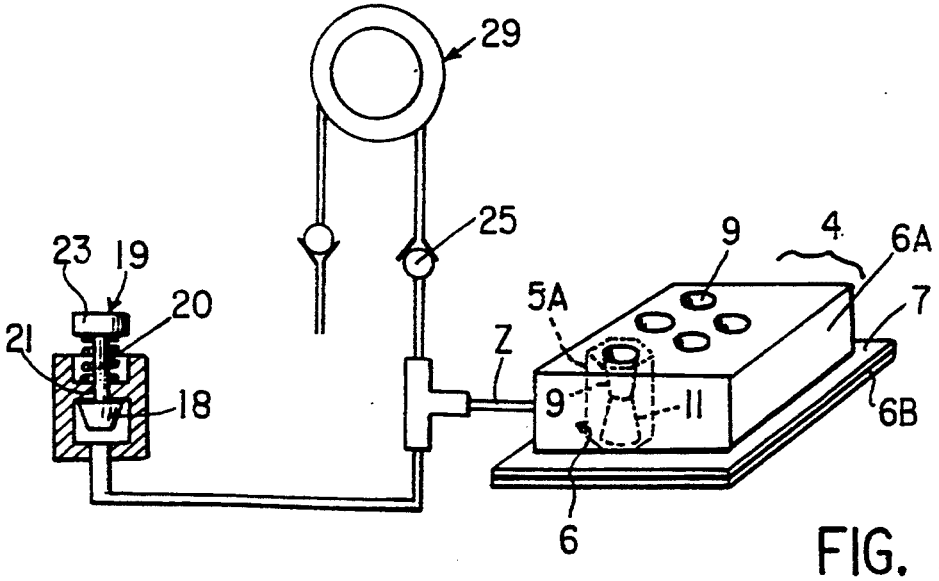
FIG. 5 is a schematic view of the pneumatic circuit of the footwear.

As shown in FIG. 4, a flexible cover 45 of elastomer material provided with a peripheral flange 46 is welded to the appendix 114 of the sole to cover and protect both the bellows pump 29 and the bleed valve 19. A hole 50 is provided in this cover for the necessary air movements.

Figure 2A:
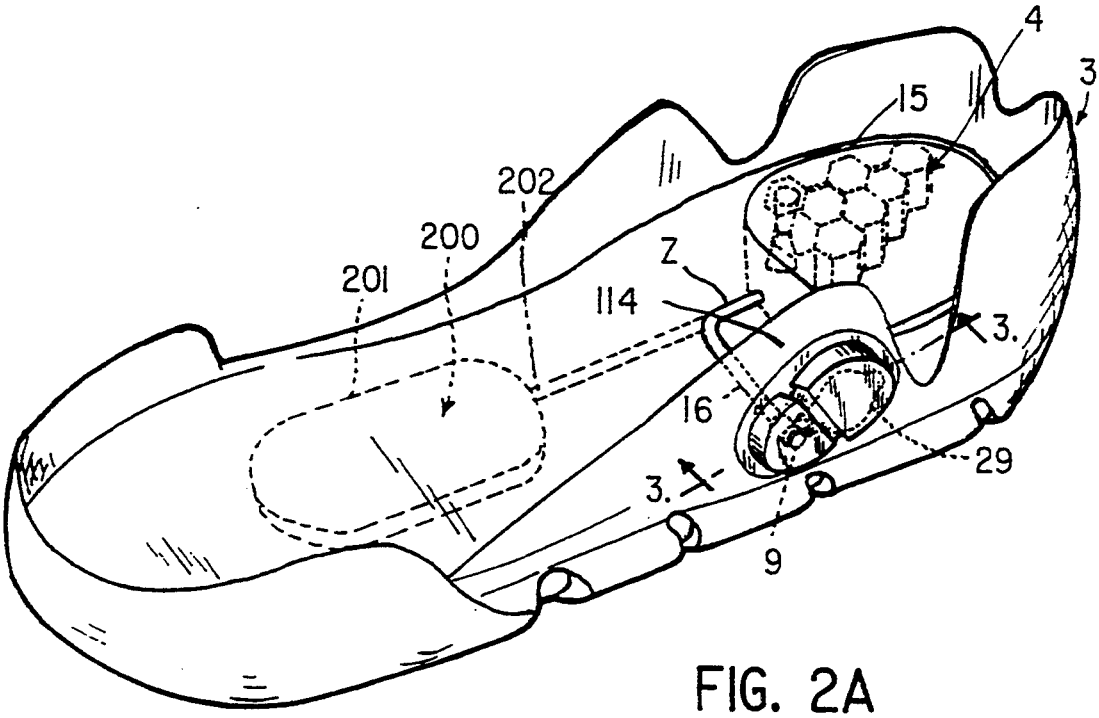
FIG. 2A is a perspective view of the sole.
Figure 2:
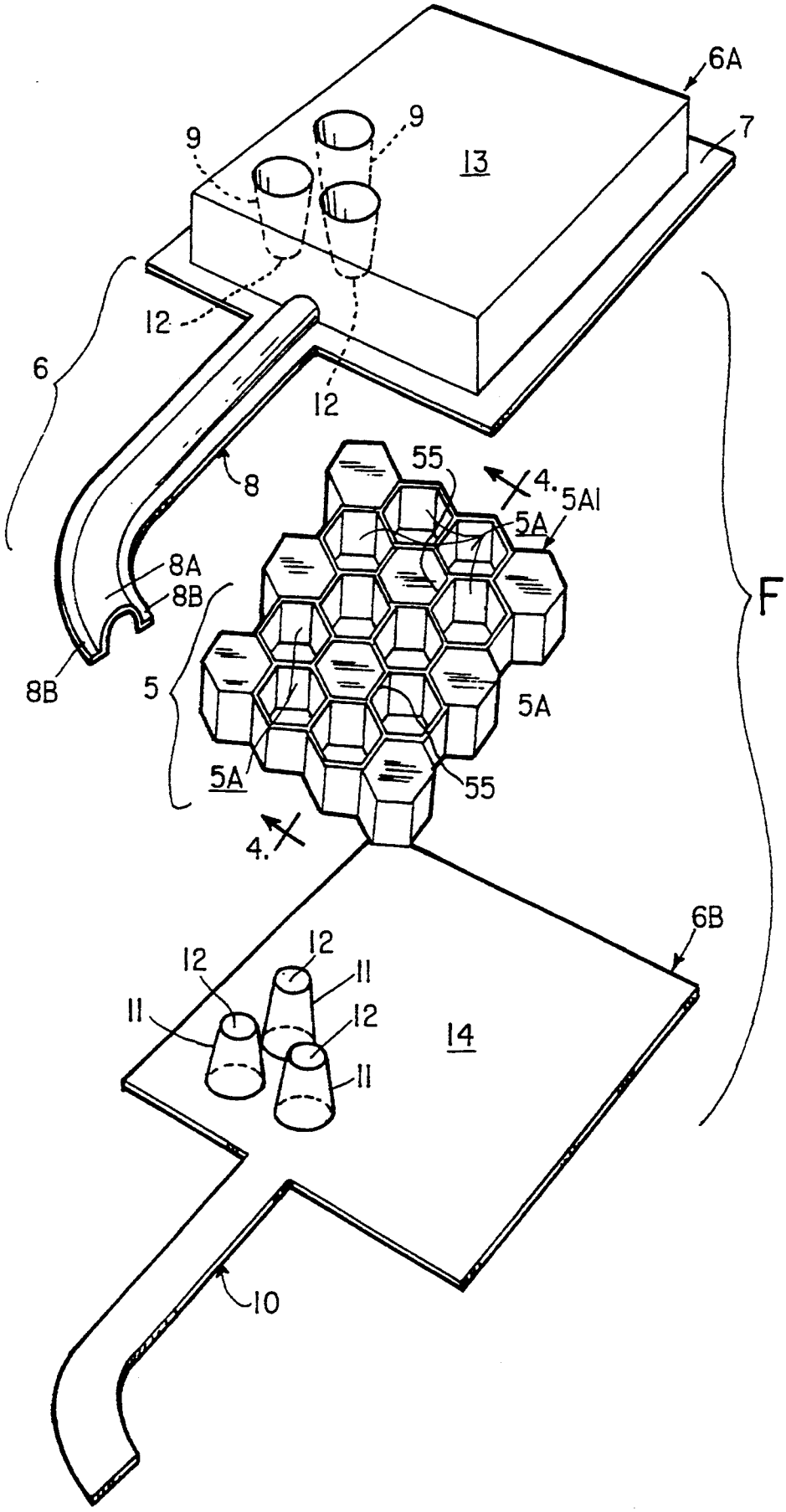
FIG. 2 is an exploded perspective view of the insert.
Figure 3:
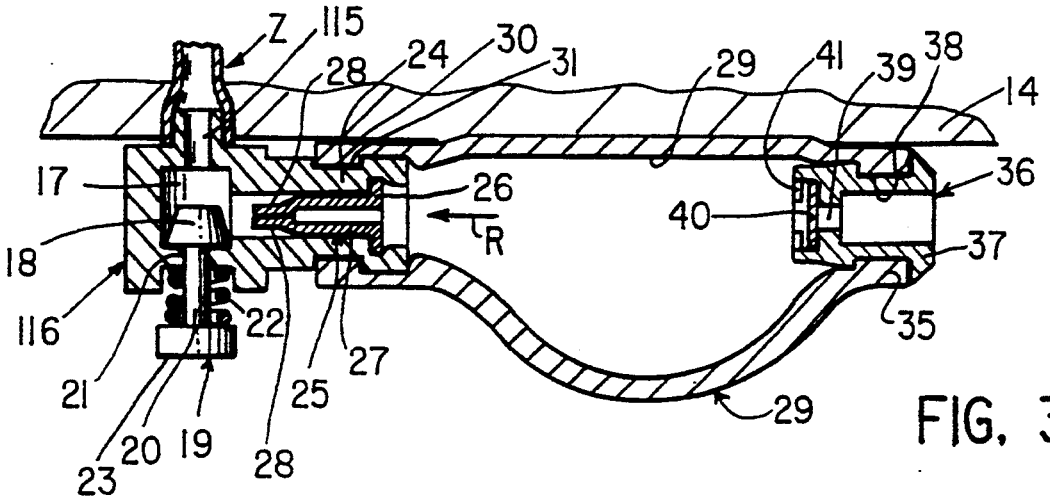
FIG. 3 is a partial sectional view taken along line III—III of FIG. 2A with the cover for the pump and bleeding valve omitted.

As FIG. 4 represents a section on the line IV—IV of FIG. 2, the reference numerals 55 indicate sections through walls common to two adjacent cells 5A, these walls lying in the sectional plane.

In FIG. 2 these walls are indicated by the same reference numerals 5.

When the person wearing the footwear wishes to stiffen the insert 4, he presses repeatedly on the bellows 29. During this pressing, the air contained in the bellows is transferred into the insert 4, so stiffening it, via the delivery valve 25 (the intake valve 36 obviously being closed). When the user releases the bellows this returns to its initial position by virtue of its elasticity, to draw air into its interior via the intake valve 36 (the delivery valve remaining closed). On achieving the required rigidity the user ceases the pumping action. If he wishes to reduce the rigidity the user discharges pressure from the insert by pressing the head 23 of the bleed valve 19, to connect the insert 4 to atmosphere.

As can be seen from FIG. 2A, the footwear can also comprise a second insert 200 formed as the insert 4 and positioned in a seat 201 provided in the front part of the sole 3.

A tube 202 similar to the tube Z pneumatically connects the insert 200 to the tube Z, allowing the rigidity of this second insert to also be simultaneously modified. This is achieved in the following manner:

a) the part 14 and the corresponding part of the insert 200 are constructed in a single piece together with the appendix 10, which joins them together and comprises a lateral branch for connection to the block 116;

b) the part 13 and the corresponding part of the insert 200 are constructed in a single piece together with the appendix 8, which joins them together and comprises a lateral branch to be superposed on that of point a), to form together therewith the pneumatic connection to the block 116.

Obviously, numerous modifications and variations of the present invention are possible in light of the above teachings. It is therefore to be understood that within the scope of the appended claims, the invention may be practiced otherwise than as specifically described herein.

I claim:

1. Improved sports footwear which comprises:

a shoe having a least one insert positioned at least in a heel region of the shoe, said insert comprising an air-impermeable casing of flexible material;

an elastically deformable member contained within said casing;

a pump mechanism; and a tube mounted at least partially in the sole for communicating said pump mechanism with said casing for varying air pressure within said casing, so as to modifying the elastic characteristics of the insert, said pump mechanism including an intake valve, a delivery valve for increasing said pressure through said tube, and a bleed mechanism for decreasing said pressure by passing air from said casing through said tube;

said pump mechanism having a bellows located on an exterior portion of the shoe and having a first and second opening, said intake valve being positioned in said first opening and said delivery valve being positioned in said second opening;

said delivery valve including a block member located outside said bellows and having a chamber connected to said bellows wherein said bleed mechanism is connected to said chamber of said block downstream of said delivery valve; wherein said air-impermeable casing including at least two parts, each part comprising an integral appendix wherein, when joined together, the appendix of each part forms a tube for passage of air from and to the insert; wherein said two parts of said casing comprise, in coinciding positions, hollow projections which are directed towards the interior of the casing and are connected together at inner ends of the projections.

2. Sports footwear as claimed in claim 1, wherein the pump and the bleed mechanism are both positioned outside the shoe and are rigidly connected therewith.

3. Sports footwear as claimed in claim 2, which comprises an elastically deformable cover connected to the shoe wherein pump and the bleed mechanism are contained within said elastically deformable cover.

4. Sports footwear as claimed in claim 1, wherein said bleed mechanism comprises a pusher-type valve.

5. Sports footwear as claimed in claim 1, wherein said elastically deformable member comprises a cellular structure.

6. Sports footwear as claimed in claim 5, wherein the cellular structure is enclosed within, but not connected to, the air-impermeable casing.

7. Sports footwear as claimed in claim 5, wherein said cellular structure comprises a honeycomb cellular structure.

8. Sports footwear as claimed in claim 1, wherein at least one pair of said hollow projections, upon being connected together, are positioned within a cell of the cellular structure.

* * * * *